United States Patent [19]

Matsui et al.

[11] 4,327,176

[45] Apr. 27, 1982

[54] DRY IMAGE FORMING MATERIAL

[75] Inventors: Ryo Matsui; Tadao Matsushika; Yoshio Hayashi; Tetsuo Shiga, all of Fuji, Japan

[73] Assignee: Asahi Kasei Kogyo Kabushiki Kaisha, Osaka, Japan

[21] Appl. No.: 203,034

[22] Filed: Nov. 3, 1980

[30] Foreign Application Priority Data

Nov. 9, 1979 [JP] Japan ..... 54-144333

[51] Int. Cl.[3] ..... G03C 1/02

[52] U.S. Cl. ..... 430/619; 430/353; 430/627; 430/939

[58] Field of Search ..... 430/353, 619, 620, 631, 430/635, 939, 627

[56] References Cited

U.S. PATENT DOCUMENTS

| | | | |
|---|---|---|---|
| 3,152,904 | 10/1964 | Sorensen et al. | 430/619 |
| 3,457,075 | 7/1969 | Morgan et al. | 430/619 |
| 3,681,475 | 8/1972 | Spilner | 260/876 R |
| 3,706,565 | 12/1972 | Ericson | 430/619 |
| 3,764,329 | 10/1973 | Lee | 430/620 |
| 3,793,402 | 2/1974 | Owens | 260/876 R |
| 3,816,132 | 6/1974 | Takegawa et al. | 430/353 |
| 4,052,525 | 10/1977 | Ide et al. | 428/412 |
| 4,105,451 | 8/1978 | Smith et al. | 430/619 |
| 4,113,496 | 12/1978 | Shiga et al. | 430/619 |
| 4,173,482 | 11/1979 | Akashi et al. | 430/619 |
| 4,180,529 | 12/1979 | Hofmann | 525/85 |
| 4,220,709 | 9/1980 | deMauriac | 430/619 |

FOREIGN PATENT DOCUMENTS 2811557 9/1978 Fed. Rep. of Germany .

*Primary Examiner*—J. Travis Brown

*Attorney, Agent, or Firm*—Sprung, Felfe, Horn, Lynch & Kramer

[57] ABSTRACT

A dry image forming material comprising (a) an organic silver salt oxidizing agent, (b) a reducing agent, (c) a photosensitive silver compound or a photosensitive silver compound-forming component and (d) a high impact acrylic resin used as a binder material of the image forming coating and/or a material of any protective layer has been found to be excellent in impact peel strength, blooming or chalking resistance and storage stability of raw material. The high impact acrylic resin (d) has an Izod impact strength of at least 0.4 ft.lb/in as measured in accordance with ASTM D 256.

16 Claims, No Drawings

DRY IMAGE FORMING MATERIAL

The present invention relates to a dry image forming material. More particularly, the invention relates to a dry image forming material which contains a high impact or impact strength-improved acrylic resin as a binder material of an image forming coating or layer and/or a material of any protective layer, and which has improved adhesion of the image forming coating to a support and/or said any protective layer, resistance to blooming or chalking, and storage stability before use thereof.

Various dry image forming materials capable of forming thereon an image only according to a dry process have been proposed. As such image forming materials, there are, for example, image forming materials using an oxidation-reduction image forming combination comprising a nonphotosensitive organic silver salt oxidizing agent such as the silver salt of a long chain fatty acid, saccharin or benzotriazole with a reducing agent for silver ions, a photosensitive compound such as a silver halide or a photosensitive compound forming-component capable of performing as a photosensitive catalyst, and the like. These image forming materials are characterized in that they can be developed by heating.

The dry image forming materials of the silver salt type include those containing a photosensitive silver halide which are photosensitive under normal lighting conditions (hereinafter often referred to as "normally photosensitive image forming material"), such as disclosed in U.S. Pat. Nos. 3,152,904 and 3,457,075, and those which are non-photosensitive under normal lighting conditions (hereinafter often referred to as "normally non-photosensitive image forming material"), such as disclosed in U.S. Pat. Nos. 3,764,329, 3,816,132, 4,113,496, and 4,173,482. The latter image forming materials can be handled under room light, provided they are not activated, and can be rendered photosensitive when they are activated, for example, by heating the same prior to exposure to light. The former image forming materials can form thereon a visible image when subjected to imagewise exposure to light and subsequent heat development, whereas the latter image forming materials can form thereon a visible image when subjected to preliminary activation, imagewise exposure to light and subsequent heat development.

A dry image forming material of the silver salt type as mentioned above is usually heat-treated at a temperature ranging from about 60° C. to about 180° C. By the heat treatment, some thermal strain is caused in the image forming coating or layer and any protective layer of the image forming material which contain as the binder material a polymer such as polymethyl methacrylate, polystyrene, cellulose acetate or a vinyl chloride-vinyl acetate copolymer, and, in most cases, the deterioration of the polymer is accelerated by any light- or heat-decomposition products of ingredients contained in the coating or layer, leading to decreased adhesion of the image forming coating to a support thereunder and/or said any protective layer thereon, which often results in some peeling therebetween. Further, the image forming material often brings about blooming or chalking which is such a phenomenon that some ingredients or additives such as a toning agent come up or rise, in the form of a powder in the case of chalking, onto the surface of the image forming material. Furthermore, this kind of dry image forming material is defective in that the storage stability of the raw image forming material prior to use thereof for image formation is unsatisfactory. Particularly when it comes to adhesion, this kind of image forming material is fatally defective in that the adhesion of the image forming coating to the support is so poor that peeling is liable to readily occur therebetween when the image forming material undergoes strong impact (impact peeling strength can be examined by the Du Pont impact test which will be detailed later).

With a view to obviating the above-mentioned defects inherent of the conventional dry image forming materials of the kind as described above, we have made intensive investigations to find that the use of a high impact or impact resistance-improved acrylic resin as a binder material of an image forming coating or layer and/or a material of any protective layer in a dry image forming material improves not only the adhesion, especially in terms of impact peeling strength, of the image forming coating to a support and/or said any protective layer but also the blooming or chalking resistance of the image forming material and the storage stability of the raw image forming material prior to use thereof. Based on such a novel finding, we have completed the present invention.

More specifically, in accordance with the present invention, there is provided a dry image forming material comprising (a) a non-photosensitive organic silver salt oxidizing agent, (b) a reducing agent for silver ions, (c) a photosensitive silver compound or a photosensitive silver compound-forming component capable of forming a photosensitive silver compound by the reaction thereof with said organic silver salt oxidizing agent (a), and (d) a high impact or impact resistance-improved acrylic resin having an Izod impact strength (notched) of at least 0.4 ft.lb/in as measured in accordance with ASTM D 256. According to a preferred embodiment of the present invention, the image forming coating or layer, which may be made either of a single layer comprising the components (a), (b) and (c) or of a plurality of separate layers each containing at least one of the components (a), (b) and (c), contains, in at least one layer thereof, the component (d), i.e. the high impact or impact resistance-improved acrylic resin. It is more preferred in the present invention that the component (d) is contained in a layer containing the component (a), i.e. the organic silver salt oxidizing agent, and/or in any layer formed just on said layer containing the component (a) and preferably containing the component (b), i.e. the reducing agent for silver ions, and/or a toning agent.

The improvement in impact peeling strength achieved by the image forming material of the present invention may be attributable to the shock-absorbing effect of the high-impact or impact resistance-improved acrylic resin (d) which may be a blend of at least one rigid thermoplastic acrylic polymer and at least one rubber-elastic polymer, or at least one copolymer comprising rigidity-providing acrylic monomer units and rubber elasticity-providing monomer units or a combination thereof with at least one rigid thermoplastic acrylic polymer and/or at least one rubber-elastic polymer. The rubber-elastic polymer and/or the rubber elasticity-providing monomer units will give the resin (d) such flexibility or deformability that the resin (d) can moderate the shock of impact when the image forming material is subjected to strong impact. The improvement in storage stability achieved beyond our expectation by the dry image forming material of the present invention is believed to be attributable to an excellent affinity of the high impact or impact resistance-improved acrylic resin (d) for various components or additives such as a reducing agent (b) and any toning agent, which affinity may be derived mainly from the rubber-elastic polymer and/or the rubber elasticity-providing monomer units. Due to said excellent affinity, the resin (d), when not heated, may keep hold of said various components or additives to hold down the diffusion of them, thus leading to excellent storage stability of the dry image forming material of the present invention. However, the resin (d) is still able to allow said various components or additives to thermally diffuse when heated at temperatures of 60° to 180° C.

As described before, the high-impact acrylic resin (d) to be used in the dry image forming material of the present invention may be a blend of at least one rigid thermoplastic acrylic polymer and at least one rubber-elastic polymer, or at least one copolymer comprising rigidity-providing acrylic monomer units and rubber elasticity-providing monomer units or a combination thereof with at least one rigid thermoplastic acrylic polymer and/or at least one rubber-elastic polymer. The high impact acrylic resin (d) has an Izod impact strength (notched) of at least 0.4 ft.lb/in, usually 0.5 to 25 ft.lb/in, most practically 0.5 to 5 ft.lb/in, as measured in accordance with ASTM D 256. The high impact acrylic resin (d) preferably contains 0.5 to 300 parts by weight, more preferably 5 to 200 parts by weight, of the rubber-elastic polymer and/or rubber elasticity-providing monomer units per 100 parts by weight of the rigid thermoplastic acrylic polymer and/or rigidity-providing acrylic monomer units.

The rigid thermoplastic acrylic polymer, which preferably has a weight average molecular weight of 5,000 to 1,000,000, more preferably 10,000 to 500,000, may be an acrylic homopolymer of an unsubstituted or substituted $C_1$–$C_4$ alkyl, cyclohexyl, $C_6$–$C_{10}$ aryl, benzyl or tetrahydrofurfuryl ester of methacrylic acid or an acrylic copolymer comprising monomer units of at least one member selected from unsubstituted or substituted $C_1$–$C_6$ alkyl, $C_6$–$C_{10}$ aryl, benzyl or tetrahydrofurfuryl esters of methacrylic acid, and is desired to have a Rockwell hardness of M 75 to M 120, preferably M 80 to M 110. The acrylic copolymer may contain up to about 10% by weight of acrylic acid and/or methacrylic acid monomer units. The substituted alkyl, aryl, benzyl or tetrahydrofurfuryl group that may be contained in the abovementioned esters of methacrylic acid may be one substituted with a halogen, nitro, amino, hydroxy or a $C_1$–$C_4$ alkoxy. Specific examples of the ester of methacrylic acid capable of forming the rigid thermoplastic acrylic polymer of either the homopolymer type or the copolymer type usable in a blend as the component (d) of the dry image forming material of the present invention include methyl methacrylate, ethyl methacrylate, cyclohexyl methacrylate, tert-butyl methacrylate, benzyl methacrylate, tetrahydrofurfuryl methacrylate, phenyl methacrylate, p-bromophenyl methacrylate, $\alpha$-naphthyl methacrylate and $\beta$-naphthyl methacrylate.

As the rubber-elastic polymer that may be suitably used for blending with the rigid thermoplastic acrylic polymer or combining with the copolymer comprising rigidity-providing acrylic monomer units and rubber elasticity-providing monomer units to form a high impact acrylic resin (d), there can be mentioned polyurethanes, styrene-butadiene copolymers, ethylene-vinyl acetate copolymers, polyacrylates and the like. The rubber-elastic polymer is desired to have a glass transition temperature of at most 80° C., preferably −80° to 40° C., more preferably −60° to 10° C. Polyacrylates are most preferred as the rubber-elastic polymer from the viewpoint of better impact peeling strength. The rubber-elastic polyacrylates preferably comprise at least 5% by weight, more preferably at least 30% by weight, of monomer units of at least one unsubstituted or substituted $C_1$–$C_{22}$ alkyl ester of acrylic acid, or at least 80% by weight, more preferably at least 90% by weight, of monomer units of at least one unsubstituted or substituted $C_7$–$C_{22}$ alkyl ester of methacrylic acid (the above-specified lower limit of amount of the monomer units of said at least one alkyl ester of methacrylic acid can be lowered when said at least one alkyl ester of methacrylic acid is used in combination with said at least one alkyl ester of acrylic acid). The substituted alkyl group that may be contained in the above-mentioned ester of acrylic acid or methacrylic acid may be one substituted with a halogen, amino, hydroxy, a $C_1$–$C_4$ alkoxy or a di($C_1$–$C_4$ alkyl)amino. Specific examples of the unsubstituted or substituted $C_1$–$C_{22}$ alkyl ester of acrylic acid include methyl acrylate, propyl acrylate, ethyl acrylate, n-butyl acrylate, isobutyl acrylate, 2-hydroxypropyl acrylate, diethylaminoethyl acrylate and dimethylaminoethyl acrylate. Specific examples of the unsubstituted or substituted $C_7$–$C_{22}$ alkyl ester of methacrylic acid include 2-ethylhexyl methacrylate, lauryl methacrylate, tridecyl methacrylate and stearyl methacrylate. The rubber-elastic polyacrylate may contain other monomer units selected from monomer units of at least one unsubstituted or substituted $C_1$–$C_6$ alkyl, $C_6$–$C_{10}$ aryl, benzyl or tetrahydrofurfuryl ester of methacrylic acid as mentioned before, styrene monomer units, ethylvinylbenzene monomer units, acrylonitrile monomer units, vinyl acetate monomer units, acrylic acid monomer units, maleic acid or anhydride monomer units and the like. It is preferred that the rubber-elastic polyacrylate be partially crosslinked by incorporating thereinto up to 20% by weight, more preferably up to 5% by weight, of monomer units of at least one crosslinkable monomer selected from divinylbenzene, ethylene glycol diacrylate, ethylene glycol dimethacrylate, diethylene glycol diacrylate, diethylene glycol dimethacrylate, glycerin triacrylate, glycerin trimethacrylate, dipropylene glycol diacrylate, dipropylene glycol dimethacrylate, butylene glycol diacrylate, butylene glycol dimethacrylate, diallyl maleate, triallyl cyanurate and the like.

The high impact acrylic resin (d) of the copolymer type, which preferably has a weight average molecular weight of 5,000 to 1,000,000, more preferably 10,000 to 500,000, may comprise rigidity-providing monomer units of at least one ester of methacrylic acid as mentioned before as being capable of forming the rigid thermoplastic acrylic polymer of the homopolymer type and 0.5 to 300% by weight, based on the rigidity-providing monomer units, of rubber elasticity or flexibility-providing monomer units of at least one member selected from unsubstituted or substituted $C_1$–$C_{22}$ alkyl esters of acrylic acid and unsubstituted or substituted $C_7$–$C_{22}$ alkyl esters of methacrylic acid which are mentioned before as being capable of forming the rubber-elastic polyacrylate.

The high impact acrylic resin (d) may also be one prepared by polymerizing, in the presence of at least one copolymer comprising rigidity-providing monomer units and flexibility-providing monomer units of the kinds as mentioned above with respect to the high impact acrylic resin (d) of the copolymer type and/or at least one rubber-elastic polymer, at least one ester of methacrylic acid as mentioned before as being capable of forming a rigid thermoplastic acrylic polymer of the homopolymer type. In this case, the acrylic resin (d) may comprise a block or graft copolymer though there remains a possibility that the resin (d) is a mere blend of said at least one copolymer and/or said at least one rubber-elastic polymer with a polymer formed from said at least one ester of methacrylic acid.

A monomer or monomers capable of copolymerizing with an ester of methacrylic acid, which may be selected, for example, from vinyl acetate, styrene, acrylonitrile, acrylic acid and maleic acid or anhydride, may be used for partial replacement thereof for the ester or esters of methacrylic acid mentioned before as being capable of forming a rigid thermoplastic acrylic polymer.

The high impact or impact resistance-improved acrylic resin (d), which may be either of the blend type, or of the copolymer type or the combination type thereof as described hereinbefore, is desired to comprise at least 50 parts by weight, preferably 80 parts by weight, of the acrylic and/or methacrylic ester component per 100 parts by weight of the acrylic resin (d). Here, the term "acrylic and/or methacrylic ester component" is intended to indicate all of monomer units of the acrylic and/or methacrylic ester type contained in the polymer or polymers constituting the acrylic resin (d).

Examples of the method for preparing the high impact acrylic resin (d) used in the dry image forming material of the present invention together with the recipe of the acrylic resin are described in U.S. Pat. Nos. 3,793,402, 4,180,529, 4,052,525 and 3,681,475.

If desired, additives of various kinds such as a lubricant, an anti-oxidizing agent, an ultraviolet absorbing agent and a colorant may be added to the high impact acrylic resin (d).

The image forming coating or layer of the dry image forming material of the present invention may be either of a single layer structure with a layer comprising all the components (a), (b) and (c) essential for image formation, or a multi-layer structure with two or more separate but contiguous layers which comprise, at least as a whole, the components (a), (b) and (c) essential for image formation and are capable of cooperating with one another for forming an image. The high impact acrylic resin (d) may be included in the image forming coating and/or a protective layer if present. As described hereinbefore, it is preferred that the high impact acrylic resin (d) be contained in a layer containing the organic silver salt oxidizing agent (a) and preferably having a thickness of 0.5 to 200μ, more preferably 3 to 30μ, and/or in a lyer, if present, formed just on said layer containing the component (a), preferably containing the reducing agent (b) for silver ions and/or a toning agent and preferably having a thickness of 0.5 to 100μ, more preferably 0.5 to 20μ. It is more preferred that the acrylic resin (d) be contained in the latter layer.

The high impact or impact resistance-improved acrylic resin (d) may be used, either singly or in combination with other polymeric substance, as the binder material of the image forming coating and/or as the material of any protective layer of the dry image forming material of the present invention. In the case of combined use of the acrylic resin (d) and other polymeric substance, the acrylic resin (d) is preferably used in an amount of at least 3% by weight, more preferably at least 8% by weight, most preferably at least 40% by weight, based on the total of the acrylic resin (d) and the other polymeric substance. Natural or synthetic polymeric substances may be used as such other polymeric substance. Representative examples of the other polymeric substance include polyvinyl butyral, cellulose acetate, polyvinyl acetate, cellulose acetate propionate, cellulose acetate butyrate, vinyl chloride-vinyl acetate copolymers, polyvinyl alcohol, polystyrene, polyvinyl formal and gelatin. They may be used either alone or in combination. When a binder consisting of the acrylic resin (d) and/or other polymeric substance is used in a layer containing the non-photosensitive organic silver salt oxidizing agent (a), it is preferred and suitable that the binder be used in such an amount that the weight ratio of the binder to the non-photosensitive organic silver salt oxidizing agent is in the range of from about 0.1 to about 10. At least one polymeric substance, such as polyvinyl butyral, polymethyl methacrylate, cellulose acetate, polyvinyl acetate, cellulose acetate propionate, cellulose acetate butyrate, a vinyl chloride-vinyl acetate copolymer, polyvinyl alcohol, polystyrene, polyvinyl formal or gelatin, may be used, without being combined with the acrylic resin (d), in one or more layers of the image forming material of the present invention, provided that the image forming material comprises the acrylic resin (d) in at least one layer thereof.

It is especially preferred that polyvinyl butyral be used as the binder of a layer containing the non-photosensitive organic silver salt oxidizing agent (a) and having thereon a layer containing a blend of polymethyl methacrylate and a copolymer comprising alkyl acrylate monomer units as the main monomer units which blend constitutes the high impact acrylic resin (d) in the present invention, the latter layer preferably containing the reducing agent (b) and/or a toning agent.

As the non-photosensitive organic silver salt oxidizing agent (a) to be used in the dry image forming material of the present invention, silver salts of long chain fatty acids, which preferably have 12 to 24 carbon atoms, are especially suitable. Preferred examples of the silver salts of long chain fatty acids include silver behenate, silver stearate, silver palmitate, silver myristate, silver laurate and silver oleate. As other suitable non-photosensitive organic silver salt oxidizing agents, there can be mentioned, for example, the silver salts of saccharin, benzotriazole, 5-substituted salicylaldoxime such as 5-chloro or -nitro salicylaldoxime, phthalazinone, 3-mercapto-4-phenyl-1,2,4-triazole and perfluoroalkanesulfonic acids. They may be used either alone or in combination. The organic silver salt oxidizing agent may be used in an amount of about 0.1 to about 50 g/m$^2$, preferably 1 to 10 g/m$^2$ of the support area of the present image forming material.

As the reducing agent (b) for silver ions, there is used an organic reducing agent which has such a suitable reducing ability that, when heated, it reduces the non-photosensitive organic silver salt oxidizing agent with the aid of catalysis of silver atoms produced in the exposed portions of the dry image forming material and constituting a latent image to form a visible silver image. Examples of the reducing agent include monohydroxybenzenes such as p-phenylphenol, p-methoxyphenol, 2,6-di-tert-butyl-4-methylphenol and 2,5-di-tert- 4-methoxyphenol; polyhydroxybenzenes such as hydroquinone, tert-butylhydroquinone, 2,6-dimethylhydroquinone, chlorohydroquinone and catechol; naphthols such as α-naphthol, β-naphthol, 4-aminonaphthol and 4-methoxynaphthol; hydroxybinaphthyls such as 1,1'-dihydroxy-2,2'-binaphthyl and 4,4'-dimethoxy-1,1'-dihydroxy-2,2'-binaphthyl; phenylenediamines such as p-phenylenediamine and N,N'-dimethyl-p-phenylenediamine; aminophenols such as N-methyl-p-aminophenol and 2,4-diaminophenol; sulfonamidophenols such as p-(p-toluenesulfonamido)phenol and 2,6-dibromo-4-(p-toluenesulfonamido)phenol; methylenebisphenols such as 2,2'-methylenebis(4-methyl-6-tert-butylphenol), 2,2'-methylenebis(4-ethyl-6-tert-butylphenol), 2,2'-methylenebis[4-methyl-6-(1-methylcyclohexyl)phenol], 1,1-bis(2-hydroxy-3,5-dimethylphenyl)-3,5,5-trimethylhexane and 2,6-bis(2'-hydroxy-3'-tert-butyl-5'-methylbenzyl)-4-methylphenol; 3-pyrazolidones such as 1-phenyl-3-pyrazolidone and 4-methyl-4-hydroxymethyl-1-phenyl-3-pyrazolidone; and ascorbic acids. A suitable reducing agent may be chosen depending on the organic silver salt oxidizing agent employed in combination therewith. For example, when there is employed as the oxidizing agent a silver salt of a long chain fatty acid such as silver behenate which is relatively hard to reduce, a relatively strong reducing agent, e.g., a bisphenol such as 2,2'-methylenebis(4-ethyl-6-tert-butyl)phenol is suitably employed. On the other hand, to organic silver salt oxidizing agents such as silver laurate which are relatively easy to reduce are suitable relatively weak reducing agents; e.g., substituted phenols such as p-phenylphenol, and to organic silver salt oxidizing agents such as the silver salt of benzotriazole which are very hard to reduce are suitable strong reducing agents such as ascorbic acids. The silver ion reducing agent that is especially suitable for the dry image forming material of the present invention is a hindered phenol in which one or two sterically bulky groups are bonded to the carbon atom or carbon atoms contiguous to the hydroxyl group-bonded carbon atom to sterically hinder the hydroxyl group. The hindered phenol has high stability to light and, hence, the use of the hindered phenol is effective for assuring a high storage stability of the raw image forming material. As examples of such hindered phenols, there can be mentioned 2,6-di-tert-butyl-4-methylphenol, 2,2'-methylenebis(4-methyl-6-tert-butylphenol), 2,2'-methylenebis(4-ethyl-6-tert-butylphenol), 1,1-bis(2-hydroxy-3,5-dimethylphenyl)-3,5,5-trimethylhexane, 2,6-methylenebis (2-hydroxy-3-tert-butyl-5-methylphenyl)-4-methylphenol, 2,2'-methylenebis[4-methyl-6-(1-methylcyclohexyl)phenol] and 2,5-di-tert-butyl-4-methoxyphenol. These reducing agents may be used either alone or in combination. The amount of the reducing agent (d) to be used varies depending on the kinds of organic silver salt oxidizing agent, reducing agent and other components to be used in the dry image forming material of the present invention. The suitable amount of the reducing agent is usually 0.1 to 3 moles per mole of the organic silver salt oxidizing agent.

The component (c) to be used in the dry image forming material of the present invention is a photosensitive silver compound or a photosensitive silver compound-forming component capable of forming a photosensitive silver compound by the reaction thereof with the organic silver salt oxidizing agent (a). Examples of the photosensitive silver compound include silver halides such as silver chloride, silver bromide, silver bromoiodide, silver chlorobromide, silver chlorobromoiodide and silver iodide. They may be used either alone or in combination. The photosensitive silver compound may be formulated, together with other components, into a composition for providing the image forming coating or layer of the dry image forming material, as usual in the field of photographic film manufacture. Alternatively, the photosensitive silver compound can be prepared in situ either in a composition for providing the image forming coating of the dry image forming material or in the coated image forming layer of the dry image forming material, by the reaction of a photosensitive silver compound-forming component with part of an organic silver salt oxidizing agent. Examples of the photosensitive silver compound-forming component include hydrogen halides such as hydrogen bromide and hydrogen iodide; metal halides such as sodium bromide, potassium bromide, calcium iodide, calcium bromide, barium iodide, lithium bromide, aluminum bromide, aluminum iodide, ferric bromide, zinc bromide, zinc iodide, cobaltous bromide, cobaltous iodide, lead iodide, lead bromide, mercuric bromide, mercuric iodide, nickel bromide, nickel iodide, palladium bromide, palladium iodide, cadmium bromide, cadmium iodide, magnesium bromide, manganese bromide and manganese iodide; halogen molecular species such as iodine, bromine and iodine bromide, and complexes of the halogen molecular species with triphenylphosphite or p-dioxane, such as triphenylphosphite nonaiodide and bromine-p-dioxane complex (see U.S. Pat. No. 4,173,482); organic haloamides such as N-bromosuccinimide, N-bromoacetamide, N-bromophthalazinone, N-bromophthalimide and N,N-dibromobenzenesulfonamide (see U.S. Pat. No. 3,764,329); diarylhalomethanes such as α-bromodiphenylmethane, α-bromodi(p-nitrophenyl)methane, α-bromodi(p-methoxyphenyl)methane, α-bromodi(p-bromophenyl)methane, α-bromodi(p-methylphenyl)methane and α-bromodi(p-phenylphenyl)methane (see U.S. Pat. No. 4,188,226); onium halides such as benzyltrimethylammonium iodide, benzyltriethylammonium hydride and cetyltrimethylammonium bromide; organometallic halides such as triphenylphosphine dibromide, bis(p-anisyl)tellurium dibromide, diphenylgermanium dibromide, triphenylgermanium bromide, triphenyltin bromide and diphenylselenium dibromide (see U.S. Pat. No. 4,113,496 in which there are mentioned as the metallic element of the organometallic halides germanium, tin, lead, phosphorus, arsenic, antimony, bismuth, selenium, tellurium and polonium); and dihalides of triphenylphosphites such as triphenylphosphite diiodide and triphenylphosphite dibromide. Of these, halogen molecular species and complexes thereof, organic haloamides, organometallic halides, diarylhalomethanes and combinations thereof are particularly useful as the photosensitive silver compound-forming component to provide a normally non-photosensitive dry image forming material which is rendered photosensitive by heating at an elevated temperature, by which heating the photosensitive silver compound-forming component is caused to react with part of the organic silver salt oxidizing agent to form the silver halide in an amount sufficient to render the image forming material photosensitive. Either the photosensitive silver compound or the photosensitive silver compound-forming component is preferably used in an amount of 0.001 to 0.5 mole per mole of the organic silver salt oxidizing agent (a).

According to need, the dry image forming material of the present invention may comprise in addition to the foregoing essential components a variety of known additives such as an anti-foggant, a spectral sensitizing dye, a chemical sensitizing agent, an anti-halation dye, a background-darkening preventing agent and a toning agent.

The representative examples of the anti-foggant include benzotriazole, mercury compounds such as mercury acetate and carboxylic acid anhydrides such as tetrachlorophthalic anhydride. The anti-foggant is effective for preventing the dry image forming material of the present invention from bringing about so-called heat fogging which is a phenomenon that the unexposed portions of a dry image forming material are blackened by heating at the time of heat development. The anti-foggant may be used in an amount of 0.005 to 10 mole %, based on the organic silver salt oxidizing agent (a).

As the spectral sensitizing dye that is useful for sensitizing a silver halide, there can be mentioned cyanine type dyes, merocyanine type dyes, styryl type dyes and the like.

As the chemical sensitizing agent, there can be mentioned, for example, triphenylphosphite, quinoline and N-methyl-2-pyrrolidone.

As the background-darkening preventing agent, there can be mentioned, for example, tetrabromobutane, hexabromocyclohexane,tribromoquinaldine and $\alpha,\alpha,\alpha'$-,$\alpha'$-tetrabromo-o-xylene. They may be used in an amount of 2.5 to 40 mole %, based on the organic silver salt oxidizing agent (a).

As the toning agent, there can be mentioned, for example, phthalazinone, combinations of phthalazine with phthalic acid or phthalic anhydride, isocyanate-blocked phthalazinones, imidazole and 3-substituted 3-pyrazolin-5-ones (see Deutshe Offenlegungsschrift No. 2,934,751).

The preferred method of preparing the dry image forming material of this invention is described by way of example as follows. An organic silver salt oxidizing agent is dispersed in a binder solution or emulsion by means of a sand grinder, a mixer, a ball mill or the like. To the resulting dispersion are added the other components and optionally various additives. The composition thus obtained is applied onto a support such as a plastic film, a glass plate, a paper or a metal plate, followed by drying in warm air or under room temperature, to prepare a dry image forming material. As the plastic film, there can be mentioned a polyethylene film, a cellulose acetate film, a polyethylene terephathalate film, a polyamide film, a polypropylene film and the like. The components of the composition may optionally be applied in two or more separate but contiguous layers. The dry thickness of the heat-developable image forming coating or layer may be 1 to 300μ, preferably 3 to 50μ. For the purposes of the protection of the heat-developable image forming coating and so on, a protective layer preferably having a thickness of 0.2 to 20μ, more preferably 0.5 to 5μ, may be provided. The material for the protective layer may be chosen from among the binder materials as mentioned hereinbefore.

Of the dry image forming materials according to the present invention, the normally photosensitive image forming material can form thereon a visible image when subjected to imagewise exposure to light and heat development which is usually conducted at a temperature of about 80° to 200° C. for about 1 to 60 seconds. On the other hand, the noramlly non-photosensitive image forming material of the present invention can form thereon a visible image when subjected to preliminary heat activation at a temperature of about 70° to 180° C. for about 1 to 60 seconds, imagewise exposure to light, and heat development which may be carried out in the same manner as described with respect to the normally photosensitive image forming material.

For the measurement of a weight average molecular weight, there may be adopted a gel phermeation chromatography (GPC) method using, as standard samples, polystyrenes manufactured by Pressure Chemical Co., U.S.A and as an apparatus, WATERS 200 manufactured by Japan-Waters Co., Japan.

The following Examples illustrate the present invention in more detail but should not be construed as limiting the scope of the invention.

In the following Examples and Comparative Examples, the impact peel strength and storage stability of dry image forming material are evaluated as follows.

Du Pont Impact Test

The impact peel strength of a dry image forming material between its base film and coating or coatings is examined according to the following procedures. The dry image forming material is placed on a stainless steel plate in such a way that the base film is contacted with the plate. Only the tip of the hemisphere of a cylindrical bar with one end thereof machined to be hemispherical with a radius of curvature of 10 mm is contacted with the upper surface of the image forming material. A stainless steel weight of 1 kg is dropped onto the other end of the cylindrical bar for a given falling distance. Whether or not any peeling between the base film and the coating or coatings has occurred is observed. The impact peel strength of the image forming material is evaluated in terms of a minimum falling distance for which the weight is dropped to cause any peeling between the base film and the coating or coatings.

The Du Pont impact test is carried out with respect to the raw materials and the imaged materials (in some Examples and Comparative Examples) before and after subjected to accelerated deterioration, the conditions of which will be described later with respect to storage stability.

Storage Stability (1) In case of normally non-photosensitive dry image forming material:

A raw image forming material is exposed to or stored under the following accelerated deteriorating conditions, and subjected to image formation which is carried out in the same manner as in Example 1 which will be given later.

[Accelerated deteriorating conditions]

Temperature: 50° C. (unless otherwise specified)
Relative Humidity: 60% (unless otherwise specified)
Storage Period: 24 hours
Place: under light of 20,000 luxes The storage stability is evaluated in terms of the minimum optical density (O.D. min) of the imaged material.

(2) In case of normally photosensitive dry image forming material:

With respect to a dry image forming material, image formation is carried out before and after the material is exposed to or stored under the following accelerated deteriorating conditions.

[Accelerated deteriorating conditions]

Temperature: 50° C.
Relative Humidity: 60% (unless otherwise specified)
Storage Period: 3 days
Place: in the dark The dry image forming material is exposed through a 21 step steptablet (manufactured by Eastman Kodak Co., Ltd., U.S.A.) to light in an amount of 250,000 lux-seconds which light is emitted from a tungsten lamp, and heat-developed at 120° C. for 30 seconds in a dark room to form an image on the material. The maximum optical density (O.D.max), minimum optical density (O.D.min) and optical density of the eighth densest image ($O.D._8$) corresponding to the eighth step counted from the step located at the end of the steptablet and giving the maximum optical density to the negative image are measured.

The storage stability of the raw image forming material is evaluated by comparing the O.D.max, O.D.min and $O.D._8$ of the material before stored with those of the material after stored under the above-mentioned accelerated deteriorating conditions.

In Examples and Comparative Examples, the symbol (A) indicates the materials of the present invention and the symbol (B) indicates the comparative materials.

EXAMPLE 1

To 20 g of a mixed solvent of toluene and methyl ethyl ketone (mixing weight ratio=1:2) was added 3 g of silver behenate, and the mixture was ball-milled for about 18 hours to obtain a homogeneous silver behenate suspension.

To 1.5 g of the silver behenate suspension were added ingredients [I] as shown below to form a silver behenate emulsion. The silver behenate emulsion was uniformly applied onto a 100μ-thick polyethylene terephthalate film at an orifice of 100μ, and air-dried at room temperature (about 20° C.). About 2 g of a reducing agent-containing composition composed of ingredients [II] as shown below was uniformly applied as a second coating layer onto the coating layer of the silver behenate emulsion at an orifice of 75μ, and air-dried at room temperature (20° C.) to obtain a normally non-photosensitive dry image forming material (A1) having a total coating layer thickness of about 18μ. The preparation of this image forming material was conducted in a light room all the time.

| Ingredients [I] | |
|---|---|
| 10 Weight % solution of polyvinyl butyral in methyl ethyl ketone | 2.0 g |
| Solution of 100 mg of mercuric acetate in 3 cc of methanol | 0.15 cc |
| α,α, α', α'-Tetrabromo-o-xylene | 25 mg |
| Triphenylphosphite | 3 mg |
| Iodine | 8 mg |
| Diphenylbromomethane | 4 mg |
| Quinoline | 30 mg |
| **Ingredients [II]** | |
| Acrylic Resin (d-1) | 6.3 g |
| 2,2'-Methylenebis(4-ethyl-6-tert-butylphenol) | 3.5 g |
| Phthalazinone | 1.2 g |
| Methyl ethyl ketone | 83 g |

Acrylic Resin (d-1) was a blend of polymethyl methacrylate and 40% by weight, based on the polymethyl methacrylate, of a rubber-elastic, partially-crosslinked copolymer obtained by the potassium persulfate-catalyzed emulsion polymerization, in water at 65° C. for 2 hours, of a mixture of 90% by weight of methyl acrylate and 10% by weight of 55% divinylbenzene (a mixture of 55% by weight of divinylbenzene and 45% by weight of ethylvinylbenzene).

The dry image forming material (A1) was preliminarily heated on a hot plate maintained at about 100° C. for 5 seconds in a dark room to render it photosensitive. Then, the material was exposed through a 21-step steptablet (manufactured and sold by Eastman Kodak Co., Ltd., U.S.A.) to light from a 300-watt tungsten lamp for 1 second. When the exposed material was heated on a hot plate maintained at about 120° C. for 5 seconds in a dark room, a black negative image was obtained.

With respect to the image forming material (A1), the results of the Du Pont impact test are shown in Table 1 which will be given later. The storage stability of the raw image forming material (A1) is shown in Table 2 which will also be given later.

EXAMPLE 2

A normally non-photosensitive dry image forming material (A2) was prepared in substantially the same manner as in Example 1 except that Acrylic Resin (d-2) was used instead of Acrylic Resin (d-1).

Acrylic Resin (d-2) was a copolymer of 80% by weight of methyl methacrylate and 20% by weight of n-butyl acrylate.

With respect to the image forming material (A2), the results of the Du Pont impact test are shown in Table 1 which will be given later. The storage stability of the raw image forming material (A2) is shown in Table 2 which will also be given later.

EXAMPLE 3

A normally non-photosensitive dry image forming material (A3) was prepared in substantially the same manner as in Example 1 except that Acrylic Resin (d-3) was used instead of Acrylic Resin (d-1).

Acrylic Resin (d-3) was a 2:1 by weight blend of Acrylic Resin (d-1) as used in Example 1 and polymethyl methacrylate.

With respect to the image forming material (A3), the results of the Du Pont impact test are shown in Table 1 which will be given later. The storage stability of the raw image forming material (A3) is shown in Table 2 which will also be given later.

COMPARATIVE EXAMPLE 1

Comparative normally non-photosensitive dry image forming materials (B1), (B2), (B3) and (B4) were prepared in substantially the same manner as in Example 1 except that polymethyl methacrylate, cellulose acetate, a vinyl chloride-vinyl acetate copolymer (vinyl chloride/vinyl acetate: 70/30 by weight) and polystyrene, which are all conventional binder materials especially useful for an overcoating, were respectively used instead of Acrylic Resin (d-1).

With respect to each comparative image forming material, the results of the Du Pont impact test are shown in table 1 below. The storage stability of each raw comparative image forming material is shown in Table 2 below.

TABLE 1

[Impact Peel Strength (cm)]

| Image Forming Material No. | Raw Material just after Preparation | Imaged Material just after preparation | Raw Material after Subjected to Accelerated Deterioration | Imaged Material after Subjected to Accelerated Deterioration |
|---|---|---|---|---|
| $A_1$ | >50 | >50 | >50 | >50 |
| $A_2$ | >50 | >50 | >50 | >50 |
| $A_3$ | >50 | >50 | >50 | 50 |
| $B_1$ | 10 | 5 | 6 | 3 |
| $B_2$ | 40 | 30 | 20 | 10 |
| $B_3$ | >50 | >50 | 40 | 30 |
| $B_4$ | 30 | 20 | 20 | 10 |

Note: In the table, ">50" means that no peeling between the base film and the coatings occurred when the weight was dropped for a falling distance of 50 cm.

TABLE 2

(Storage Stability)

| Image Forming Material No. | $A_1$ | $A_2$ | $A_3$ | $B_1$ | $B_2$ | $B_3$ | $B_4$ |
|---|---|---|---|---|---|---|---|
| O.D.min after Subjected to Accelerated Deterioration | 0.12 | 0.11 | 0.14 | 0.22 | 0.15 | 0.42 | 0.19 |

It is apparent from Tables 1 and 2 that the use of a high impact acrylic resin in a dry image forming material according to the present invention markedly improves the impact peel strength and storage stability of the material.

EXAMPLE 4

To 20 g of a mixed solvent of toluene and methyl ethyl ketone (mixing weight ratio=1:2) was added 3 g of silver behenate, and the mixture was ball-milled for about 18 hours to obtain a homogeneous silver behenate suspension.

To 1.5 g of the silver behenate suspension were added ingredients [III] as shown below to form a silver behenate emulsion. The silver behenate emulsion was uniformly applied onto a 100μ-thick polyethylene terephthalate film at an orifice of 100μ, and air-dried at room temperature (about 20° C.). About 2 g of a reducing agent-containing composition composed of ingredients [IV] as shown below was uniformly applied as a second coating layer onto the coating layer of the silver behenate emulsion at an orifice of 75μ, and air-dried at room temperature (20° C.) to obtain a normally photosensitive dry image forming material (A4) having a total coating layer thickness of about 18μ. The preparation of this image forming material was conducted in a dark room all the time.

| Ingredients [III] | |
|---|---|
| 10 Weight % solution of polyvinyl butyral in methyl ethyl ketone | 2.0 g |
| Solution of 100 mg of mercuric acetate in 3 cc of methanol | 0.05 cc |
| α,α,α',α'-Tetrabromo-o-xylene | 25 mg |
| Triphenylphosphite | 3 mg |
| Hydriodic acid (specific gravity: 1.7) | 0.05 cc |
| Diphenylbromomethane | 4 mg |

| Ingredients [IV] | |
|---|---|
| Acrylic Resin (d-4) | 6.3 g |
| 2,2'-Methylenebis(4-ethyl-6-tert-butylphenol) | 3.5 g |
| Phthalazinone | 1.3 g |
| Methyl ethyl ketone | 83 g |

Acrylic Resin (d-4) was a polymer latex obtained by subjecting a mixture of 90 parts by weight of n-butyl acrylate, 10 parts by weight of methyl methacrylate and 0.6 part by weight of triallyl cyanurate to potassium persulfate-catalyzed emulsion polymerization in water at 70° C. for 2 hours under an atmosphere of nitrogen to prepare a latex (solids content: about 33% by weight) of a crosslinked acrylic elastomer and subsequently subjecting a mixture of 30.3 parts by weight of the crosslinked acrylic elastomer latex, 6 parts by weight of acrylonitrile, 12 parts by weight of styrene, 12 parts by weight of methyl methacrylate and 0.3 part by weight of ethylene glycol dimethacrylate to potassium persulfate-catalyzed emulsion polymerization at 70° C. for 2 hours.

The dry image forming material (A4) was allowed to stand at room temperature for one month in a dark room. Thereafter, the surface of the image forming material was observed by means of an optical microscope to find that no powdery deposit was present on the surface of the material (no chalking occurred).

COMPARATIVE EXAMPLE 2

Comparative normally photosensitive dry image forming materials (B5) and (B6) were prepared in substantially the same manner as in Example 4 except that polystyrene and cellulose acetate were respectively used instead of Acrylic Resin (d-4). The dry image forming materials (B5) and (B6) were allowed to stand under the same conditions as in Example 4. The presence of a powdery deposit (occurrence of chalking) was observed on the surface of either of the image forming materials.

It is apparent from Example 4 and Comparative Example 2 that the use of a high impact acrylic resin in the overcoating of a dry image forming material according to the present invention effectively suppresses the occurrence of chalking as compared with the use of conventional binder materials.

EXAMPLE 5

To 20 ml of an isopropyl alcohol solution containing 2 g of polyvinyl butyral was added 2.5 g of silver behenate and the mixture was ball-milled for 8 hours to obtain a silver behenate suspension.

To 20 ml of the silver behenate suspension were added ingredients (V) as shown below to form a silver behenate emulsion. The silver behenate emulsion was so applied onto a 100μ-thick transparent polyethylene terephthalate film support that the amount of silver behenate was 1.5 g per $m^2$ of the support, followed by drying. A reducing agent-containing composition composed of ingredients [VI] as shown below was uniformly applied as a second coating layer onto the coating layer of the silver behenate emulsion, and air-dried at room temperature (20° C.) to obtain a normally photosensitive dry image forming material (A5) having a second coating layer thickness of about 10μ. The preparation of this image forming material was conducted in a dark room all the time.

| Ingredients [V] |
|---|
| 2.5 Weight % solution of ammonium bromide |

-continued

| | |
|---|---|
| in methanol | 1 ml |
| 0.025 Weight % chloroform solution of benzoxazolylidene rhodanine sensitizing dye of the formula: | 1 ml |

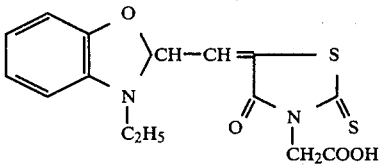

| | |
|---|---|
| 25 Weight % solution of phthalazinone in methyl cellosolve | 1 ml |

| Ingredients [VI] | |
|---|---|
| Acrylic Resin (d-1) as used in Example 1 | 6.3 g |
| 25 Weight % methyl cellosolve solution of 2,2'-methylenebis(4-ethyl-6-tert-butylphenol) | 14.0 g |
| Methyl ethyl ketone | 80 g |

The data for evaluating the storage stability of the raw image forming material (A5) are shown in Table 3 which will be given later.

EXAMPLE 6

A normally photosensitive dry image forming material (A6) was prepared in substantially the same manner as in Example 5 except that Acrylic Resin (d-2) as used in Example 2 was used instead of Acrylic Resin (d-1).

The data for evaluating the storage stability of the raw image forming material (A6) are shown in Table 3 which will be given later.

EXAMPLE 7

A normally photosensitive dry image forming material (A7) was prepared in substantially the same manner as in Example 5 except that Acrylic Resin (d-5) was used instead of Acrylic Resin (d-1).

Acrylic Resin (d-5) was a polymer obtained by subjecting a mixture of 61.5 parts by weight of n-butyl acrylate, 13.5 parts by weight of styrene and 0.4 part by weight of butylene glycol diacrylate to potassium persulfate-catalyzed emulsion polymerization in water at 70° C. for 30 minutes to prepare a copolymer, polymerizing at 70° C. for 1 hour 25 parts by weight of methyl methacrylate in the presence of said copolymer to prepare a rubbery elastomer and subsequently subjecting a 4% by weight dispersion of said rubbery elastomer dispersed in a monomer mixture composed of 96% by weight of methyl methacrylate and 4% by weight of ethyl acrylate to free-radical polymerization at 80° C. for 1 hour.

The data for evaluating the storage stability of the raw image forming material (A7) are shown in Table 3 which will be given later.

COMPARATIVE EXAMPLE 3

Comparative normally photosensitive dry image forming materials (B7), (B8) and (B9) were prepared in substantially the same manner as in Example 5 except that polymethyl methacrylate, a vinyl chloride-vinyl acetate copolymer (vinyl chloride/vinyl acetate: 70/30 by weight) and cellulose acetate were respectively used instead of Acrylic Resin (d-1).

The data for evaluating the storage stability of each of the raw comparative image forming materials (B7), (B8) and (B9) are shown in Table 3 below.

TABLE 3

(Storage Stability)

| Image Forming Material No. | Just after Preparation O.D. max | O.D.$_8$ | O.D.min | After 3 Days' Storage under Accelerated Deteriorating Conditions O.D.max | O.D.$_8$ | O.D.min |
|---|---|---|---|---|---|---|
| A5 | 2.7 | 1.7 | 0.08 | 2.7 | 1.7 | 0.10 |
| A6 | 2.8 | 1.8 | 0.09 | 2.8 | 1.8 | 0.12 |
| A7 | 2.7 | 1.7 | 0.09 | 2.4 | 1.6 | 0.15 |
| B7 | 2.8 | 1.7 | 0.08 | 1.9 | 1.4 | 0.40 |
| B8 | 2.7 | 1.8 | 0.08 | 1.7 | 1.3 | 0.75 |
| B9 | 2.7 | 1.7 | 0.08 | 1.8 | 1.4 | 0.45 |

It is apparent from Table 3 that dry image forming materials according to the present invention in which high impact acrylic resins are used in the overcoatings are substantially zero or extremely small in decrease of O.D.max as well as O.D.$_8$ and in increase of O.D.min even when stored for 3 days under the accelerated deteriorating conditions, as compared with dry image forming materials in which conventional binder materials are used in the overcoatings. It is concluded from this that high impact acrylic resins impart excellent storage stability to raw dry image forming materials.

EXAMPLE 8

A normally non-photosensitive dry image forming material (A8) was prepared in substantially the same manner as in the preparation of the dry image forming material (B2) in Comparative Example 1 except that a mixture of 1.8 g of a 10 weight % solution of polyvinyl butyral in methyl ethyl ketone and 0.2 g of a 10 weight % solution of Acrylic Resin (d-4) as used in Example 4 in methyl ethyl ketone was used instead of 2.0 g of a 10 weight % solution of polyvinyl butyral in methyl ethyl ketone which solution was used in the composition for the coating layer containing silver behenate (non-photosensitive organic silver salt oxidizing agent) in Comparative Example 1.

As a result of the Du Pont impact test of the dry image forming material (A8), it was found that, even when the stainless steel weight was dropped for a falling distance of 50 cm, no peeling occured in any of the raw materials and the imaged materials before and after subjected to the accelerated deterioration. When the image forming material (A8) is compared with the image forming material (B2), it is apparent that the use of a high impact acrylic resin in a dry image forming material according to the present invention greatly improves the impact peel strength of the material.

EXAMPLE 9

To 20 g of a mixed solvent of toluene and methyl ethyl ketone (mixing weight ratio = 1:2) was added 3 g of silver stearate, and the mixture was ball-milled for about 20 hours to obtain a homogeneous silver stearate suspension.

To 1.5 g of the silver stearate suspension were added ingredients [VII] as shown below to form a silver stearate emulsion. The silver stearate emulsion was uniformly applied onto a 100μ-thick polyethylene terephthalate film at an orifice of 100μ, and air-dried at room temperature (about 20° C.). A 10 weight % solution of Acrylic Resin (d-4) as used in Example 4 in methyl ethyl ketone was uniformly applied onto the coating layer of the silver stearate emulsion, and air-dried at room temperature (20° C.) to form an about 3μ-thick protective layer. Thus, a normally photosensitive dry image forming material (A9) having a total coating layer thickness of about 12μ was obtained. The preparation of this image forming material was conducted in a dark room all the time.

| Ingredients [VII] | |
|---|---|
| 10 Weight % solution of polyvinyl butyral in methyl ethyl ketone | 2.0 g |
| Solution of 100 mg of mercuric acetate in 3 cc of methanol | 0.05 cc |
| α,α,α',α'-Tetrabromo-o-xylene | 25 mg |
| Triphenylphosphite | 3 mg |
| Hydriodic acid (specific gravity: 1.7) | 0.05 cc |
| α-Bromodiphenylmethane | 4 mg |
| 2,2'-Methylenebis(4-ethyl-6-tert-butylphenol) | 106 mg |
| Phthalazinone | 23 mg |

The data for evaluating the storage stability (relative humidity in accelerated deterioration: 90%) of the raw image forming material (A9) are shown in Table 4 which will be given later.

COMPARATIVE EXAMPLE 4

A comparative normally photosensitive dry image forming material (B10) was prepared in substantially the same manner as in Example 9 except that a vinyl chloride-vinyl acetate copolymer (vinyl chloride/vinyl acetate: 70/30 by weight) was used as the material of a protective layer instead of Acrylic Resin (d-4).

The data for evaluating the storage stability (relative humidity in accelerated deterioration: 90%) of the raw image forming material (B10) are shown in Table 4 below.

TABLE 4

| Image Forming Material No. | (Storage Stability) Just after Preparation O.D. max | O.D.$_8$ | O.D.min | After 3 Days' Storage under Accelerated Deteriorating Conditions O.D.max | O.D.$_8$ | O.D.min |
|---|---|---|---|---|---|---|
| A9 | 2.2 | 1.4 | 0.08 | 2.0 | 1.3 | 0.25 |
| B10 | 2.2 | 1.4 | 0.08 | 1.4 | 1.2 | 0.90 |

It is apparent from Table 4 that the image forming material (A9) according to the present invention is very small in changes of O.D.max, O.D.$_8$ and O.D.min under the accelerated deteriorating conditions and, hence, has an excellent storage stability as compared with the comparative image forming material (B10).

EXAMPLE 10

A normally non-photosensitive dry image forming material (A10) was prepared in substantially the same manner as in Example 1 except that Acrylic Resin (d-6) was used instead of Acrylic Resin (d-1).

Acrylic Resin (d-6) was a blend of polymethyl methacrylate and 40% by weight, based on the polymethyl methacrylate, of Tufprene A (trade name of a stryene-butadiene block copolymer manufactured by Asahi Kasei Kogyo Kabushiki Kaisha, Japan).

With respect to the image forming material (A10), the results of the Du Pont impact test are shown together with the storage stability of the raw material in Table 5 which will be given later.

EXAMPLE 11

A normally non-photosensitive dry image forming material (A11) was prepared in substantially the same manner as in Example 1 except that Acrylic Resin (d-7) was used instead of Acrylic Resin (d-1).

Acrylic Resin (d-7) was a blend of polymethyl methacrylate and 40% by weight, based on the polymethyl methacrylate, of a rubber-elastic, partially-crosslinked copolymer obtained by the potassium persulfate-catalyzed emulsion polymerization, in water at 60° C. for 2 hours, of a mixture of 90% by weight of methyl acrylate and 10% by weight of dipropylene glycol dimethacrylate.

With respect to the image forming material (A11), the results of the Du Pont impact test are shown together with the storage stability of the raw material in Table 5 which will be given later.

COMPARATIVE EXAMPLE 5

A comparative normally non-photosensitive dry image forming material (B11) was prepared in substantially the same manner as in Example 1 except that Tufprene A as used in Example 10 was used instead of Acrylic Resin (d-1).

With respect to the image forming material (B11), the results of the Du Pont impact test are shown together with the storage stability of the raw material in Table 5 below.

TABLE 5

| Image Forming Material No. | [Impact Peel Strength (cm) and Storage Stability] Impact Peel Strength (cm) just after Preparation Preparation | Raw Material after Subjected to Accelerated Deterioration | O.D.min after Subjected to Accelerated Deterioration |
|---|---|---|---|
| A10 | >50 | >50 | 0.02 |
| A11 | >50 | >50 | 0.09 |
| B11 | >50 | 6 | 0.43 |

EXAMPLE 12

Normally non-photosensitive dry image forming materials (A12), (A13), (A14), (A15), (A16), (A17) and (A18) were prepared in substantially the same manner as in Example 1 except that blends of a styrene-n-butyl acrylate copolymer (h) and polymethyl methacrylate (the blends have varied blending weight ratios as listed in Table 6 which will be given later) were respectively used instead of Acrylic Resin (d-1).

The above-mentioned copolymer (h) was one obtained by stirring under an atmosphere of nitrogen at 80° C. for 2 hours a mixture of 40 parts by weight of styrene, 10 parts by weight of n-butyl acrylate, 1 part by weight of azobisisobutyronitrile and 50 parts by weight of toluene to effect free radical polymerization and removing the toluene from the reaction mixture under reduced pressure.

With respect to each of the image forming materials, the results of the Du Pont impact test are shown in Table 7 which will be given later. The storage stability of each raw image forming material is shown in Table 6 which will also be given later.

In this Example, the temperature and relative humidity in accelerated deterioration were 60° C. and 90%, respectively.

COMPARATIVE EXAMPLE 6

The comparative dry image forming materials (B1) and (B4) prepared in Comparative Example 1 were subjected to accelerated deterioration under the same conditions as in Example 12.

With respect to the image forming materials (B1) and (B4), the results of the Du Pont impact test are shown in Table 7 below. The storage stability of each raw image forming material is shown in Table 6 below.

TABLE 6

(Storage Stability)

| Image Forming Material No. | Blending Weight Ratio | Total Acrylic and/or Methacrylic Ester Component Content (wt %) | O.D.min after Subjected to Accelerated Deterioration |
|---|---|---|---|
| B4 | polystyrene: 100% | 0 | 0.51 |
| A12 | copolymer (h)/PMMA: 7/1 | 30 | 0.42 |
| A13 | copolymer (h)/PMMA: 3/1 | 40 | 0.40 |
| A14 | copolymer (h)/PMMA: 1/1 | 60 | 0.23 |
| A15 | copolymer (h)/PMMA: 1/3 | 80 | 0.12 |
| A16 | copolymer (h)/PMMA: 1/6 | 89 | 0.11 |
| A17 | copolymer (h)/PMMA: 1/39 | 98 | 0.11 |
| A18 | copolymer (h)/PMMA: 1/100 | 99 | 0.16 |
| B1 | PMMA: 100% | 100 | 0.30 |

Note
PMMA: polymethyl methacrylate

TABLE 7

[Impact Peel Strength (cm)]

| Image Forming Material No. | B4 | A12 | A13 | A14 | A15 | A16 | A17 | A18 | B1 |
|---|---|---|---|---|---|---|---|---|---|
| Raw Material just after Preparation | 30 | 50 | >50 | >50 | >50 | >50 | >50 | 50 | 10 |
| Raw Material after Subjected to Accelerated Deterioration | 10 | 40 | >50 | >50 | >50 | >50 | 50 | 50 | 6 |

EXAMPLE 13

A normally non-photosensitive dry image forming material (A19) was prepared in substantially the same manner as in Example 1 except that Acrylic Resin (d-8) was used instead of Acrylic Resin (d-1).

Acrylic Resin (d-8) was a blend of 50% by weight of polymethyl methacrylate and 50% by weight of a product which had been obtained by subjecting a mixture of 30 parts by weight of methyl methacrylate and 0.05 part by weight of diallyl maleate to potassium persulfate-catalyzed emulsion polymerization in water at 65° C. for 2 hours to form a first polymer emulsion, subjecting a mixture of all the first polymer emulsion, 40.5 parts by weight of n-butyl acrylate, 9.5 parts by weight of styrene and 1 part by weight of diallyl maleate to potassium persulfate-catalyzed emulsion polymerization at 70° C. for 1 hour to form a second polymer emulsion and subsequently subjecting a mixture of all the second polymer emulsion, 19.2 parts by weight of methyl methacrylate and 0.8 part by weight of ethyl acrylate to potassium persulfate-catalyzed emulsion polymerization at 80° C. for 1 hour.

With respect to the image forming material (A17), the results of the Du Pont impact test and the storage stability of the raw material were as follows.

Impact Peel Strength (cm):
- Raw Material just after Preparation: >50
- Imaged Material just after Preparation: >50
- Raw Material after Subjected to Accelerated Deterioration: >50
- Imaged Material after Subjected to Accelerated Deterioration: >50

Storage Stability:
- O.D.min after Subjected to Accelerated Deterioration: 0.08

EXAMPLE 14

A normally non-photosensitive dry image forming material (A20) was prepared in substantially the same manner as in Example 1 except that a 10 weight % solution of Acrylic Resin (d-2) as used in Example 2 in methyl ethyl ketone was used instead of the 10 weight % solution of polyvinyl butyral in methyl ethyl ketone in the ingredients [I].

With respect to the image forming material (A20), the results of the Du Pont impact test and the storage stability of the raw material were as follows.

Impact Peel Strength (cm):
- Raw Material just after Preparation: >50
- Imaged Material just after Preparation: >50
- Raw Material after Subjected to Accelerated Deterioration: >50
- Imaged Material after Subjected to Accelerated Deterioration: >50

Storage Stability:
- O.D.min after Subjected to Accelerated Deterioration: 0.09

EXAMPLE 15

To 1.5 g of a silver behenate suspension as prepared in Example 1 were added ingredients [VIII] as shown below to form a silver behenate emulsion. The silver behenate emulsion was uniformly applied onto a 100μ-thick polyethylene terephthalate film at an orifice of 100μ, and air-dried at room temperature (about 20° C.) to obtain a normally non-photosensitive dry image forming material (A21) having a coating layer thickness of about 11μ. The preparation of this image forming material was conducted in a light room all the time.

| Ingredients [VIII] | |
|---|---|
| 10 Weight % solution of Acrylic Resin (d-1) in methyl ethyl ketone | 2.0 g |
| Solution of 100 mg of mercuric acetate in 3 cc of methanol | 0.15 cc |
| α,α,α',α'-Tetrabromo-o-xylene | 25 mg |
| Triphenylphosphite | 3 mg |
| Iodine | 8 mg |
| Diphenylbromomethane | 4 mg |
| Quinoline | 30 mg |
| 2,2'-Methylenebis(4-ethyl-6-tert-butylphenol) | 3.5 g |
| Phthalazinone | 1.2 g |

The O.D.min of the imaged material (A21) after subjected to the accelerated deterioration was 0.10.

As is apparent from the preceding Examples 1 to 15 and Comparative Examples 1 to 6, dry image forming materials which comprises a high impact acrylic resin in accordance with the present invention are greatly improved over and compare very much favorably with conventional dry image forming materials in respect of impact peel strength, chalking resistance and storage stability of raw material.

The Izod impact strengths (notched) of the polymer materials used in Examples and Comparative Examples were examined in accordance with ASTM D 256 and found to be as shown in Table 8 below.

TABLE 8

| Polymer Material | Izod Impact Strength (Notched) (ft . lb/in) |
|---|---|
| Acrylic Resin (d-1) | 0.93 |
| Acrylic Resin (d-2) | 0.95 |
| Acrylic Resin (d-3) | 0.70 |
| Acrylic Resin (d-4) | 0.87 |
| Acrylic Resin (d-5) | 0.52 |
| Acrylic Resin (d-6) | 0.42 |
| Acrylic Resin (d-7) | 1.55 |
| Acrylic Resin (d-8) | 1.10 |
| copolymer (h)/PMMA: 7/1 | 0.88 |
| copolymer (h)/PMMA: 3/1 | 0.95 |
| copolymer (h)/PMMA: 1/1 | 1.03 |
| copolymer (h)/PMMA: 1/3 | 0.72 |
| copolymer (h)/PMMA: 1/6 | 0.65 |
| copolymer (h)/PMMA: 1/39 | 0.54 |
| copolymer (h)/PMMA: 1/100 | 0.41 |
| PMMA (polymethyl methacrylate) | 0.30 |

What is claimed is:

1. A dry image forming material comprising:

(a) a non-photosensitive organic silver salt oxidizing agent;

(b) a reducing agent for silver ions;

(c) a photosensitive silver compound or a photosensitive silver compound-forming component capable of forming a photosensitive silver compound by the reaction thereof with said organic silver salt oxidizing agent (a); and (d) a high impact acrylic resin having an Izod impact strength (notched) of at least 0.4 ft.lb/in as measured in accordance with ASTM D 256 and consisting essentially of a blend of at least on rigid thermoplastic acrylic polymer and at least one rubber-elastic polymer, or at least one copolymer comprising rigidity-providing acrylic monomer units and rubber elasticity-providing monomer units or a combination thereof with at least one rigid thermoplastic acrylic polymer and/or at least one rubber-elastic polymer; or consisting essentially of one prepared by polymerizing at least one member selected from unsubstituted $C_1$–$C_4$ alkyl, cyclohexyl, $C_6$–$C_{10}$ aryl, benzyl or tetrahydrofurfuryl esters of methacrylic acid in the presence of at least one rubber-elastic polymer and/or at least one copolymer comprising rigidity-providing monomer units and rubber elasticity-providing monomer units;

said at least one rigid thermoplastic acrylic polymer being an acrylic homopolymer of an unsubstituted $C_1$–$C_4$ alkyl, cyclohexyl, $C_6$–$C_{10}$ aryl, benzyl or tetrahydrofurfuryl ester of methacrylic acid, or an acrylic copolymer comprising monomer units of at least one member selected from unsubstituted $C_1$–$C_6$ alkyl, $C_6$–$C_{10}$ aryl, benzyl or tetrahydrofurfuryl esters of methacrylic acid, and being of M 75 to M 120 in Rockwell hardness;

said at least one copolymer comprising rigidity-providing monomer units of at least one member selected from unsubstituted $C_1$–$C_4$ alkyl, cyclohexyl, $C_6$–$C_{10}$ aryl, benzyl or tetrahydrofurfuryl esters of methacrylic acid and 0.5 to 300% by weight, based on the rigidity-providing monomer units, of rubber elasticity-providing monomer units of at least one member selected from unsubstituted $C_1$–$C_{22}$ alkyl esters of acrylic acid and unsubstituted $C_7$–$C_{22}$ alkyl esters of methacrylic acid.

2. A dry image forming material as claimed in claim 1, wherein the component (d) is contained in a layer containing at least one of the components (a), (b) and (c).

3. A dry image forming material as claimed in claim 1, wherein the component (d) is contained in a layer containing the component (a), and/or a layer formed on said layer containing the component (a).

4. A dry image forming material as claimed in claim 3, wherein the component (d) has an Izod impact strength (notched) of 0.5 to 25 ft.lb/in as measured in accordance with ASTM D 256.

5. a dry image forming material as claimed in claim 1, wherein said at least one rubber-elastic polymer has a glass transition temperature of at most 80°.

6. A dry image forming material as claimed in claim 5, wherein said at least one rubber-elastic polymer has a glass transition temperature of −80° to +40° C.

7. A dry image forming material as claimed in claim 1, wherein said at least one rigid thermoplastic acrylic polymer has a weight average molecular weight of 5,000 to 1,000,000.

8. A dry image forming material as claimed in claim 1, wherein said at least one copolymer has a weight average molecular weight of 5,000 to 1,000,000.

9. A dry image forming material as claimed in claim 1, wherein the component (d) contains 0.5 to 300 parts by weight of the rubber-elastic polymer and/or rubber elasticity-providing monomer units per 100 parts by weight of the rigid thermoplastic acrylic polymer and/or rigidity-providing acrylic monomer units.

10. A dry image forming material as claimed in claim 1, wherein said acrylic copolymer further contains monomer units of at least one member selected from the group consisting of styrene, vinyl acetate, acrylonitrile, acrylic acid and maleic acid or anhydride.

11. A dry image forming material as claimed in claim 1, wherein said at least one rubber-elastic polymer is a member selected from the group consisting of polyurethanes, styrene-butadiene copolymers, ethylene-vinyl acetate copolymers and polyacrylates.

12. A dry image forming material as claimed in claim 11, wherein said at least one rubber-elastic polymer is a polyacrylate comprising at least 5% by weight of monomer units of at least one member selected from unsubstituted $C_1$–$C_{22}$ alkyl esters of acrylic acid, and has a glass transition temperature of at most 80° C.

13. A dry image forming material as claimed in claim 11, wherein said at least one rubber-elastic polymer is a polyacrylate comprising at least 80% by weight of monomer units of at least one member selected from unsubstituted $C_7$–$C_{22}$ alkyl esters of methacrylic acid, and has a glass transition temperature of at most 80° C.

14. A dry image forming material as claimed in claim 11, wherein said at least one rubber-elastic polymer is a polyacrylate partially crosslinked.

15. A dry image forming material as claimed in claim 1, wherein the component (d) comprises at least 50 parts by weight of the acrylic and/or methacrylic ester component per 100 parts by weight of the component (d).

16. A dry image forming material as claimed in claim 1, wherein the component (a) is contained in a layer containing polyvinyl butyral and the component (d) is a blend of polymethyl methacrylate and a copolymer comprising alkyl acrylate monomer units which blend is contained in a layer formed on the layer comprising the component (a) and the polyvinyl butyral.

* * * * *

UNITED STATES PATENT AND TRADEMARK OFFICE

CERTIFICATE OF CORRECTION

PATENT NO. : 4,327,176
DATED : April 27, 1982

INVENTOR(S) : Ryo Matsui et al

It is certified that error appears in the above-identified patent and that said Letters Patent are hereby corrected as shown below:

| | |
|---|---|
| Col. 5, line 57 | Delete "lyer" and insert --layer--. |
| Col. 8, line 42 | Delete "hydride" and insert --bromide--. |
| Col. 18, line 31 | Second column before "just after" insert --Raw Material--; same column delete "preparation" in one instance. |
| Col. 21, line 42 | Second line from bottom, delete "on" and insert --one--. |
| Col. 22, line 20 | Delete "3" and insert --1--. |

Signed and Sealed this

Sixth Day of July 1982

[SEAL]

Attest:

GERALD J. MOSSINGHOFF

Attesting Officer

Commissioner of Patents and Trademarks